US006779480B2

(12) United States Patent
Zamjahn

(10) Patent No.: US 6,779,480 B2
(45) Date of Patent: Aug. 24, 2004

(54) DIAL INDICATOR CAP

(76) Inventor: David B. Zamjahn, 7506 77th St., Chaska, MN (US) 55318

( * ) Notice: Subject to any disclaimer, the term of this patent is extended or adjusted under 35 U.S.C. 154(b) by 0 days.

(21) Appl. No.: 10/180,628

(22) Filed: Jun. 25, 2002

(65) Prior Publication Data

US 2003/0000452 A1 Jan. 2, 2003

Related U.S. Application Data

(60) Provisional application No. 60/300,670, filed on Jun. 25, 2001.

(51) Int. Cl.[7] ..... B65D 55/00

(52) U.S. Cl. ..... 116/308; 116/309; 215/230

(58) Field of Search ..... 116/311, 308, 116/309, 312, 316, 317, 318; 215/230, DIG. 3

(56) References Cited

U.S. PATENT DOCUMENTS

| | | | | |
|---|---|---|---|---|
| 4,365,722 A | * | 12/1982 | Kramer | 215/220 |
| 4,501,370 A | | 2/1985 | Kelley | |
| 4,802,438 A | | 2/1989 | DeJonge | |
| 4,920,912 A | * | 5/1990 | Kirkling | 116/308 |
| 5,184,739 A | * | 2/1993 | Kusz | 215/220 |
| 5,438,886 A | | 8/1995 | Knowles, Jr. et al. | |
| 5,577,335 A | * | 11/1996 | Tucker | 40/311 |
| 5,638,970 A | * | 6/1997 | Garby et al. | 215/219 |
| 5,678,712 A | * | 10/1997 | Rios | 215/220 |
| 5,765,706 A | * | 6/1998 | Barker et al. | 215/230 |
| 5,984,122 A | * | 11/1999 | Barker et al. | 215/230 |
| 6,003,467 A | | 12/1999 | Shelton-Ferrell et al. | |
| 6,276,533 B1 | * | 8/2001 | Kaplan | 206/534 |

OTHER PUBLICATIONS

Dial/Disc circular wheel—dose calculations (Providers only–not consumser).
"Slide Rule" Mechanism (Providers only—not consumers).
Basic "Dosing Chart" (Prodivers Only—Not consumers).

* cited by examiner

*Primary Examiner*—Diego Gutierrez
*Assistant Examiner*—Tania C. Courson
(74) *Attorney, Agent, or Firm*—Gray Plant Mooty Mooty and Bennett, P.A.; Malcolm D. Reid

(57) ABSTRACT

A rotatable dial, with first and second windows, mounted on top of a container closure cap; imprinted first set of information on top of the cap positioned to be sequentially viewable throughout its entire range through the first window upon indexed rotation of the dial; imprinted second set of information on top of the cap positioned to be sequentially viewable throughout its entire range through the second window when the first window is set to view a bit of the first set of information; and the second set of information is dependently related to the first set of information.

24 Claims, 8 Drawing Sheets

DIAL INDICATOR CAP

CROSS REFERENCE TO A RELATED APPLICATION

This application claims the benefit of U.S. Provisional Patent Application Serial No. 60/300,670, filed Jun. 25, 2001.

BACKGROUND OF THE INVENTION

Field of Use

The field of use for the dial indicator cap described in this specification is for determining the required amount of a substance, such as a medication, as a function of a variable, such as the weight of a patient. However, the concept and structure described and claimed in this specification is useful for determining the amount of a first substance as a function of a second substance for myriad applications. An example of another application is the volume of oil to be added to a volume of gasoline for a two-cycle engine, which is determined by the the manufacturer's specified ratio of oil to gasoline multiplied by the gasoline volume. For purposes of illustration of an embodiment of the invention claimed in this specification, a medication application will be the application described in the "Summary of an Embodiment of the Invention," the "Brief Description Of The Drawings", and the "Detailed Description And Operation Of The Invention" sections of this specification.

SUMMARY OF AN EMBODIMENT OF THE INVENTION

Inaccurate prescriptive medication suspension, such as antibiotics, and over-the-counter liquid medication dosing in the pediatric patient population (3 years of age and younger) is common and costly. The medical literature is abundant with statistics and objective data supporting the finding that inaccurate medication dosing in the pediatric patient population is a common problem. For example, a significant number of pediatric patients are: hospitalized with medication dosing errors; die as a result of dosing errors; taken to emergency rooms with persistent fever-related illnesses due to under-dosage with acetaminophen; and treated for overdosage with acetaminophen. Studies confirm that a large majority of caregivers: fail to give the required dosage of the over-the-counter medication acetaminophen; do not accurately read and follow labeling instructions; fail to increase dosage as the pediatric patient's age or weight increases; or give less than the manufacturer's recommended dosage. It is also known that: over-the-counter pediatric medications have no specific instructions for dosing a child under the age of 2; for most over-the-counter pediatric medication in liquid form, the dosing instructions are by "age" for children under the age 2 and by "weight" for children above the age 2, which is conflicting and unclear; and when the medication bottle is removed from the packaging and the packaging is discarded, the complicated dosing instructions, which are generally on the packaging, are no longer available to the caregiver.

There must be greater assurance that the medication recommended for the pediatric population is dosed correctly. Medication labeling is the only tool available to assure the consumer of accurate dosing. However, labeling has proven to be ineffective, confusing, costly, and controversial. Improving the label will not dramatically improve the rate of accuracy in dosing medications. A simple, inexpensive, consumer friendly device for dosing accuracy should replace the current standard of labeling. And, the dosing information should be integral to the medication container. The dial indicator cap is such a simple, inexpensive, consumer friendly device to replace or supplement the labeled dosage information. Indeed, like the label, it is integral to the medication container.

The dial indicator cap is a unique, innovative combination of a closure cap for a medication container and a device for determining dosage for prescriptive and over-the-counter medications. It utilizes existing closure cap design concepts with minimal modification. The dial indicator cap either minimizes the need for detailed labeling or is an adjunct to labeling. It provides an almost error proof method for the consumer to determine dosage. Even when used in conjunction with a label, it becomes the primary source for proper dosing. The basic closure for medication bottles remains the same. The invention of this specification comprises a range of pediatric patient weights and corresponding dosage amounts imprinted on the top, outer surface of the closure cap. A rotatable disk is axially aligned with and superimposed over the closure cap with a first viewing window that when rotated displays the various weights imprinted on the top, outer surface of the closure cap and a second viewing window that when rotated displays the corresponding medication dosage imprinted on the top, outer surface of the closure cap. The consumer simply rotates the disk to display the pediatric patient's weight in the first viewing window and then views the dosage in the second viewing window. A click-stop index means, which is designed to cause a clicking action between the viewing disk and closure cap, locks-in the weight and corresponding dosage information. A consumer in an "English" units system will find milliliters and pounds to be the most convenient and understandable units of measure. Therefore, it is preferred that these units be imprinted on the top of the closure cap so that all necessary information for precise dosing is contained on the dose cap and conversion to other units is not necessary. In a "metric" unit system, it will, be preferred that the numbers be imprinted in metric units. Current labeling practices allow the use of metric units in an "English" unit country such as the United States of America, further compounding the probability of dosing errors.

The purchaser of a prescription medication or an over-the-counter medication in a container capped with the dial indicator cap, needs to only know the child's weight. The purchaser who is usually the parent dials in the child's weight so it is visible through a first window and then reads the precise dose shown in a second window. The dose is then poured into a suitable measuring instrument and administered to the child.

Some of the objects of the dial indicator cap are to: be a replacement or adjunct for the confusing, costly, detailed labeling system currently in use; be the primary source for determining dosage as a function of weight or some other factor; simplify parental dosing instructions; be an inexpensive modification of existing closure caps while allowing incorporation of currently used child safety cap features; be consumer friendly; improve caregiver compliance with dosing instructions; ensure precise dosing of all pediatric medications; allow adjustment to dosing with a child's advancing weight and age; reduce dosing errors and related costs; meet the expectations of the consumer and medical community; meet or exceed Food and Drug Administration regulations and policies on dosing; allow accurate dosing for children under 2 years old; maintain all dosing instructions as an integral part of the medication container, so packaging materials may be discarded without concern; significantly improve and safeguard the health and safety of pediatric children; and improve the efficacy of pediatric medication by assisting accurate dosing.

Each dial indicator cap is tailored to a specific medication according to the manufacturer's specifications. The cap may be tailored, for example, to accommodate all prescriptive antibiotic suspensions for children and all over-the-counter pediatric liquid medications.

This "Summary of an Embodiment of the Invention" section describes a medication application embodiment of the invention claimed in this specification only for purposes of illustration. It is to be understood that this invention may be used for myriad other applications.

BRIEF DESCRIPTION OF THE DRAWINGS OF AN EMBODIMENT OF THE INVENTION

This "Brief Description of the Drawings" section refers to a medication application embodiment of the invention claimed in this specification only for purposes of illustration. It is to be understood that this invention may be used for myriad other applications.

DETAILED DESCRIPTION AND OPERATION OF THE INVENTION

Figure 1:
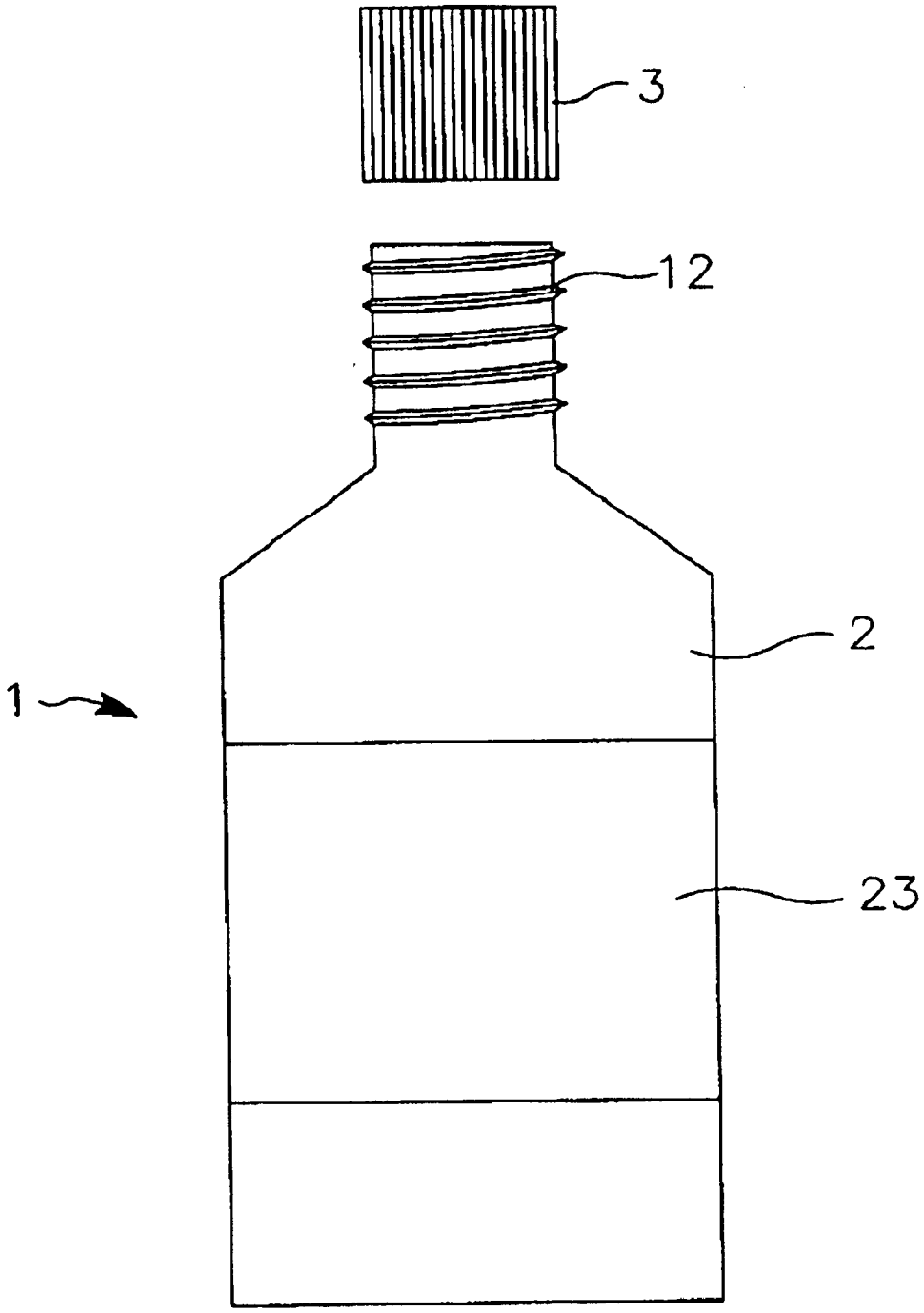
Prior Art FIGURE 1
FIG. 1 illustrates a prior art medication bottle having a cap, container, label, and threaded neck.

FIG. 1 illustrates an example of a prior art medication bottle 1, comprising a cap 3, a container 2, a label 23, and a thread 12 on the bottle neck most often used to contain a liquid pharmacological substance for dispensing to a consumer. Variants of a prior art medication bottle 1 may be found on most pharmacy shelves. They are used for dispensing both prescription and over-the-counter fluid medication. Medication bottle 1 may be used for containing liquids used for animals, humans, or plants. Prior art medication bottle 1 may contain almost any type of liquid, including a medicant or a toxic fluid such as a poison, weed killer, or pesticide.

Typically, a pharmacist or the manufacturer states the dosage on the bottle label 23, such as two teaspoons twice per day. In the case of medications for pediatric patients, such simple dosage instructions fail to account for the weight of the child, which can vary widely from patient to patient or change dramatically as an infant gains weight over the course of its treatment regimen. Without changing the dosage to account for differences in weight among the various pediatric patients or for the change in weight over time for any given patient, the dosage can be dramatically excessive or inadequate. Very often instructions are included with medication bottle 1 that alerts the caregiver (generally a parent) of the necessity of increasing the dosage as the child's weight increases. These instructions are often discarded by the caregiver with the disposal of the box in which medication bottle 1 is contained or if such warning instructions are on label 23 (space limitations often will not allow inclusion of such detail on a label) they are difficult for the caregiver to follow, forgotten, or too small to be easily read.

Figure 2:
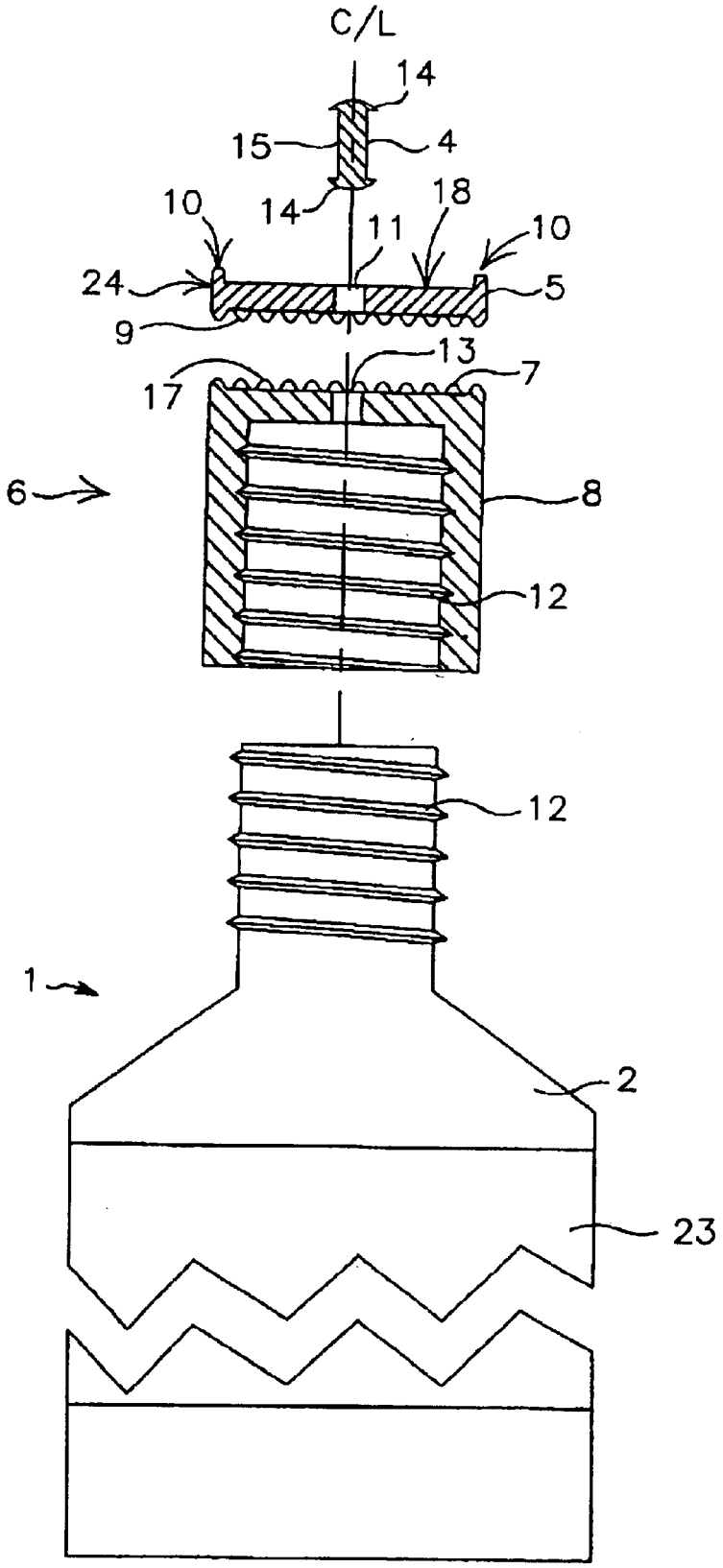
FIG. 2 is an exploded elevational view of an embodiment of a dial indicator cap of the invention described in this specification.

The present invention improves prior art medication bottle 1 by replacement of prior art cap 3 with a unique, innovative, and consumer friendly dial indicator cap 6. FIG. 2 illustrates an exploded cross sectional elevational view of an exemplar of dial indicator cap 6. Dial indicator cap 6 serves dual functions. It functions as an indicator of the amount of fluid to be administered for various child weights or other variables. And, it functions as a cap for closure of prior art medication bottle 1.

Figure 7:
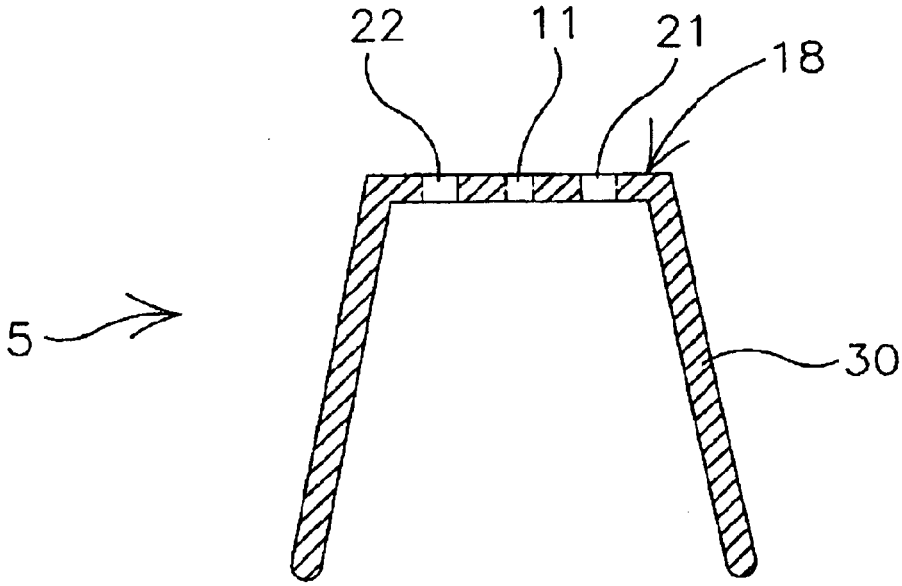
FIG. 7 is a elevational cut-a-way view of another embodiment of the closure cap portion of the dial indicator closure cap.

To the extent shown in FIG. 2, dial indicator cap 6 is comprised of closure cap 8, dial 5, and a means for rotatably affixing dial 5 to top of closure cap 17, such as for example by rivet 4. Dial 5 is rotatably fixed to closure cap 8 by rivet 4, which extends in axially alignment (as shown by centerline, C/L) through dial aperture 11 and closure cap aperture 13. Rivet 4 is of such a length that when inserted and fastened at both of its head ends 14 it positions dial 5 and top of closure cap 17 into planar mating engagement, yet allows the consumer to rotate dial 5 with respect to top of closure cap 17 using only minimal finger pressure. The minimal finger pressure must be enough that once dial 5 is rotated, it will not rotate further without the application once again of such minimal pressure. As illustrated, finger grip bumps 10 may be integrally molded into dial 5 to give a frictional surface to dial 5 to allow the consumer's fingers to rotate dial 5. Finger grip bumps 10, as illustrated, are only one of many means available to one skilled in the art for providing a finger grip. For example, scoring, knurling, or serration of sidewall 24 are means for providing a frictional surface to assist the using for rotating dial 5. Sidewall 24 vertical dimension may require enlargement to accommodate the user's fingers when gripping sidewall 24. For purposes of this specification, vertical shall be defined as the direction from the top of prior art medication container 2 with dial indicator cap 6 in position for closure of container 2 when the base of container 2 is placed on a horizontal surface. Sidewall 24 may also be enlarged by extending side wall 24 down vertically in an annular ring to form a hood 30 over the upper portion of closure cap 8, as shown in FIG. 7. To do so, requires that the inside diameter of hood 30 portion of dial 5 be slightly larger than the diameter of top of closure cap 17. Hood 30 could also limit lateral movement of dial 5 relative to the top of closure cap 17, provide a guide way for smoother rotation of dial 5, and prevent upward bending of dial 5, depending on how closely its inside dimensions match the outside dimensions of container 2. Dial click stop serration 9 and matingly engaged closure cap click stop serration 7 provide frictional engagement of dial 5 and top of closure cap 17 so that once the user rotates dial 5 to the desired position relative to closure cap 8, dial 5 will stay in the chosen position, sometimes referred as an indexed position, until further rotation by consumer/user. Dial indicator cap 6 must be designed so that a comfortable frictional force of the user is sufficient to overcome the resistance of serration's 7 and 9 to rotate dial 5, yet not allow the usual nonconsumer/nonuser forces to spontaneously change dial 5 setting. Mating serrations 7 and 9 is only one approach of many to inhibit dial 5 from rotating by normally encountered forces other than the user's force. For example, instead of annular serrations 7 and 9, illustrated in FIG. 2, annular serrations could be placed inside the wall of hood 30 described above and mating serrations positioned in an annular ring on the upper portion of outside of closure cap 8. Secure closure means of dial indicator cap 6 to a container 2 may be accomplished by use of internal threads 12 in closure cap 8, as shown in FIG. 2, for mating engagement with outside threads on medication container 2, as shown in FIG. 1, or the treads could be reversed so that the threads on closure cap 8 are on its outside wall and the mating threads on container 2 are on its inside. A removable or irremovable snap lock may also be used for a secure closure means of cap 6 to container 2. There are other methods of secure closure means known by one skilled in the art that are suitable means of closure.

Figure 3:
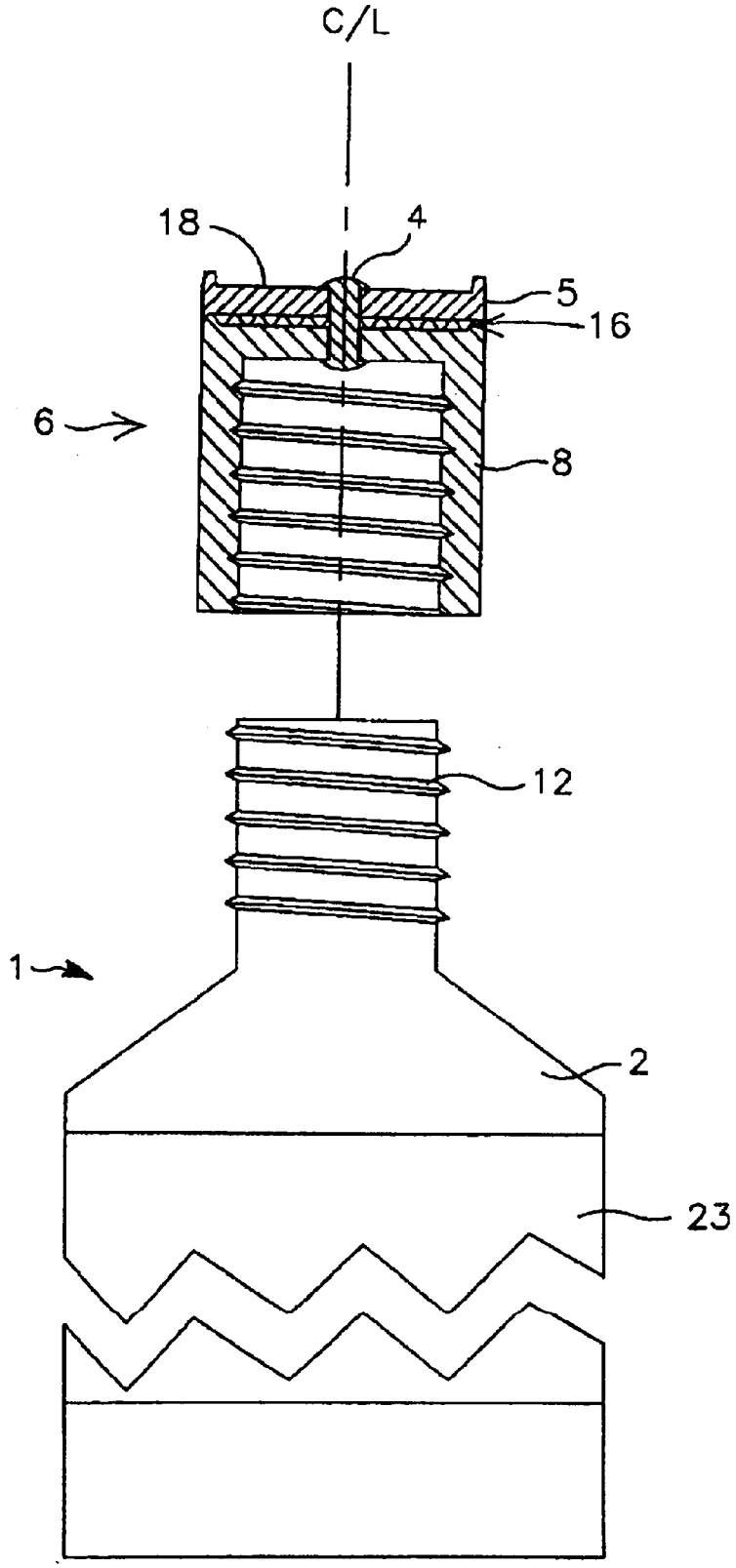
FIG. 3 is an assembled elevational view of the dial indicator cap of FIG. 2.

FIG. 3 illustrates assembled dial indicator cap 6. For clarity, serrations 7 and 9, finger grip bumps 10, and threads 12 are not shown. Rivet 4 may be molded plastic with upper and lower heads 14 added after rivet shaft 15 is inserted through dial and closure cap apertures 11 and 13. An alternative means of forming rivet heads 14 is by a compressive force (sometimes including heat in the case of plastics) simultaneously exerted against the top and bottom of an inserted rivit shaft 15, thereby squishing the ends of rivit shaft 15 to form rivit heads 14 in situ. Whichever method is used to form rivit heads, rivet 4 must rotatably fix dial 5 to closure cap 8. Care must be taken to avoid compressing dial 5 too tightly against top of closure cap 17 to the point that rotation by normal finger pressure is not possible. Furthermore, rivet 4 can be formed with a head 14 formed on one end and a prong in the shape of an arrowhead formed on the other end. The shoulder of the prong is of a larger diameter than dial and closure cap apertures 11 and 13. The prong is driven through apertures 11 and 13, whereby the prong and apertures are deformed to accommodate the prong, and then, due to the resilient nature of the plastic material out of which the prong of rivit 4, dial 5, and closure cap 8 are made, the prong of rivit 4, closure cap aperture 13, and dial aperture 11 return to their original shape. Due to the shoulder of the prong, the prong cannot be retracted from aperture 13. Of course, any manufacturing method that reaches the goal of rotatably fixing dial 5 to closure 8 is acceptable, including eliminating rivet 4 entirely. The goal is to have a user rotatable dial 5 on top of closure cap 17. As shown in FIG. 3, there is some space 16 between dial 5 and closure cap 8. Space 16 as shown is enlarged for illustration purposes only. Space 16 would most likely be small enough that dial 5 and top of closure cap 17 are touching one another, yet free to rotate relative to one another.

Figure 4A:
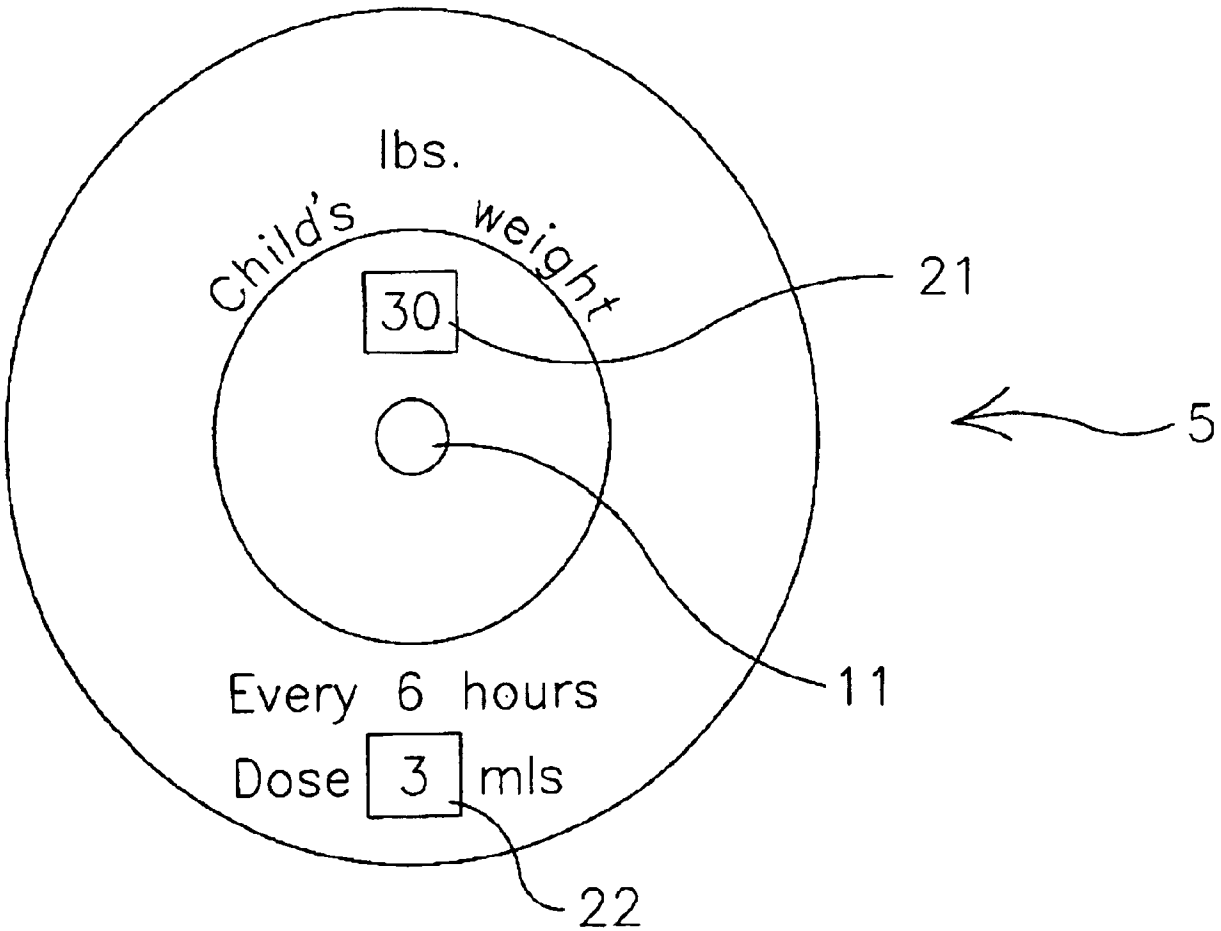
FIG. 4A is a plan view of the dial of the dial indicator cap.
Figure 4B:
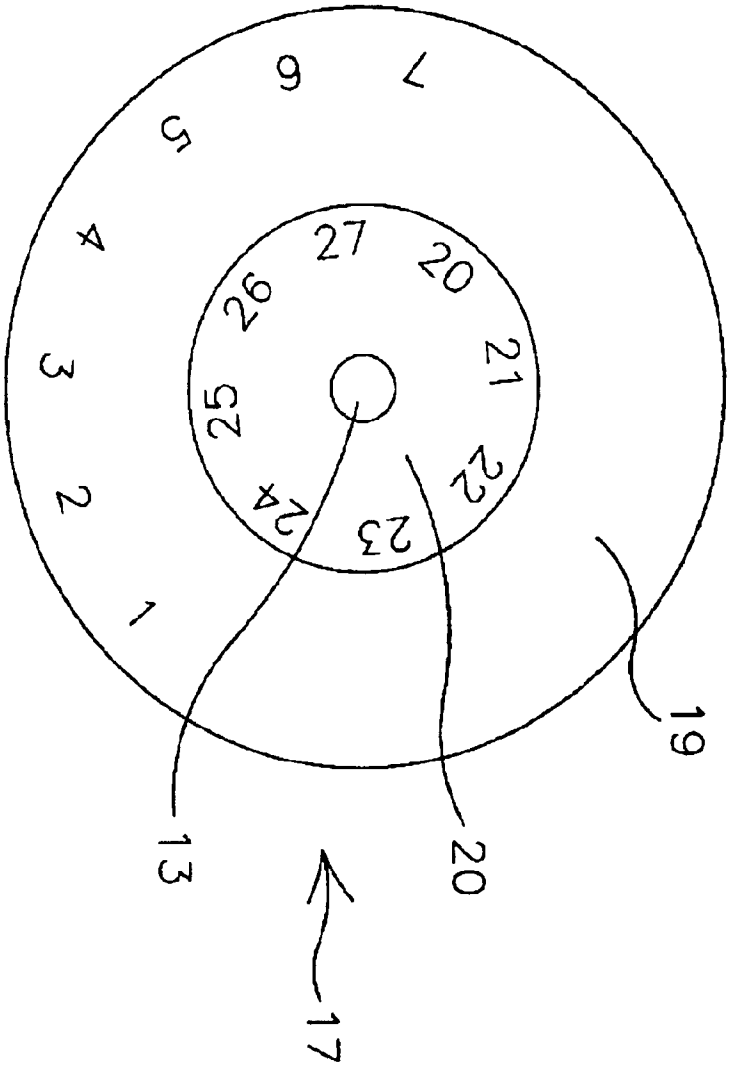
FIG. 4B is a plan view of imprinted numbers on the top of closure cap.

FIG. 4A is a view of top of dial 18 and FIG. 4B is a view of top of closure cap 8. FIG. 4B illustrates the dosage of the fluid to be administered, imprinted in outer ring 19, and the corresponding weight of the child to whom it will be administered or other variable, imprinted in inner ring 20 of top of closure cap 17. FIG. 4A illustrates first window 21 and second window 22, for respectively dialing in the patient's weight and then viewing the corresponding prescribed dosage. Alternatively, first window 21 can be used for dosage and second window 22 can be used for weight. Furthermore, first and second windows 21 and 22 can be used for any other related variables. Weight and dosage units may be imprinted on top of dial 18 in close proximity to windows 21 and 22, respectively. FIG. 4A, for illustration purposes only, shows them in milliliters and pounds, respectively. The dosage can be in ounces, teaspoons, liters, milligrams, or any other appropriate unit. Milliliters is the most commonly used units for pediatric patients, although most pharmaceutical companies state dosage in milliliters per kilogram of weight, which is not very useful for the average consumer in the United States. Dosage will most likely be imprinted on outer ring 19 because pediatric dosage generally has a wider range than does weight. This then requires a greater circumference than does the weight range to make the weight and the corresponding dosage appear in their respective windows 21 and 22 throughout each of their ranges. Dosage amounts will generally be fitted into an arc of 180 degrees or less when on outer ring 19. Alternatively, in certain special cases, which may be of a nonmedical application, dosage could be on inner ring 20 and the other variable such as weight placed on outer ring 19. FIG. 4A is a conceptual illustration for an antibiotic suspension and over-the-counter liquid medication. In the illustrated case, the frequency of dosage is indicated as every 6 hours and is a constant regardless of the child's weight. Preferably, the frequency of dosage will be imprinted on dial 5. The dosage is determined as a function of both the child's weight and the frequency of dosage. FIG. 4B illustrates dosage along a circumferential arc in outer ring 19 so that when first window 21 is moved to the patient's weight, which weights are displayed along a circumferential arc in the inner ring 20 on top of closure cap 17, second window 22 frames the correct dosage number on outer ring 19 on top of closure 17. The placement of numbers in inner and outer rings 19 and 20 along their respective circumferential arcs and the distance of rings 19 and 20 from the center of top of the closure 17 will differ for the chosen range of weights and the concomitant dosages for any given medication. Usually, the diameter of inner ring 20 depends upon the number of arc degrees or radians that the numbers in outer ring 19 occupy and also upon how many discrete numbers are placed on inner ring 20. In other words, each dial indicator cap 6 will differ as to placement of windows 21 and 22 and the numbers on outer and inner rings 19 and 20, depending upon the medication being dispensed.

Generally, the pharmaceutical company distributing the medication will supply the medication with a dial indicator cap 6 specifically made for that medication. For ease of viewing by the consumer, the colors of the numbers appearing in each of windows 21 and 22 should be different than one another. For example, the number color appearing in window 21 could be yellow and the number color in window 22 could be red. In a similar manner, the color on the dial along the outer circumferential area where window 22 is located could be green and the inner circumferential area where window 21 is located could be purple.

Figure 5:
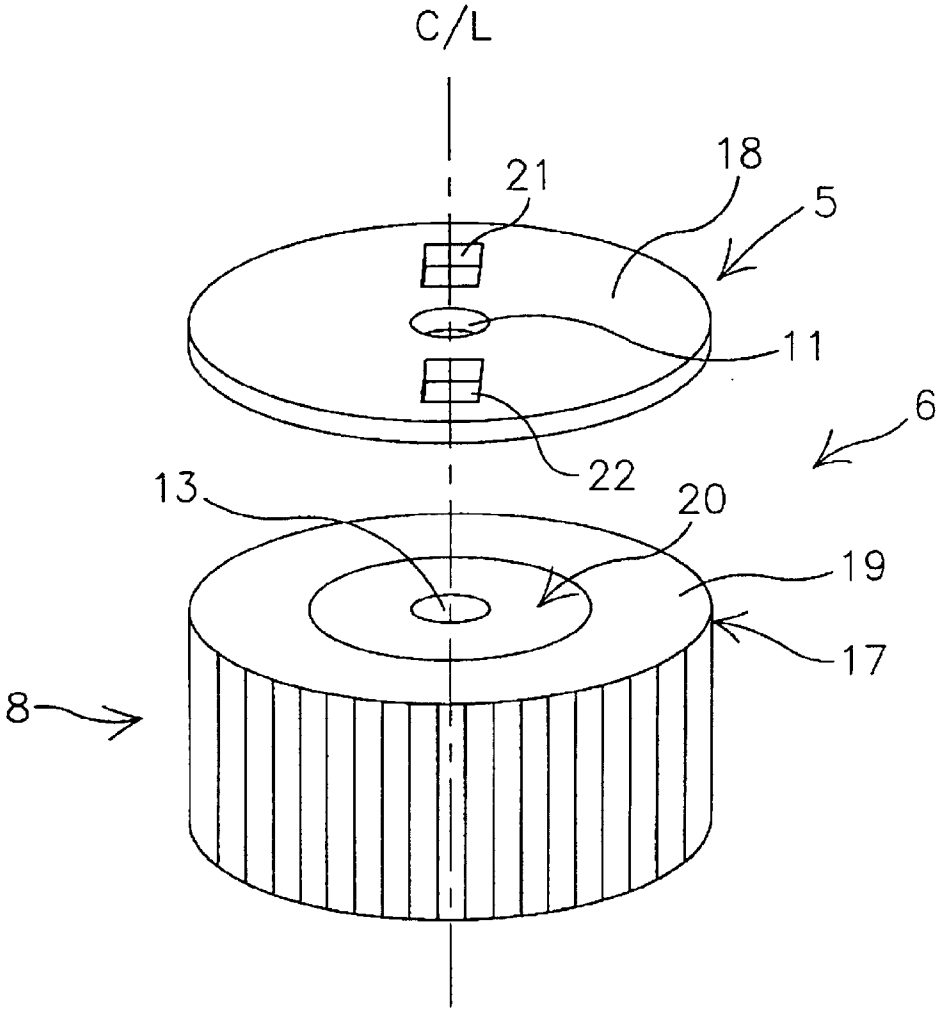
FIG. 5 is an exploded isometric view of the dial indicator cap.

FIG. 5 shows an exploded perspective view of an exemplary embodiment of the dial indicator cap 6 described in this specification. Weight window 21 and dosage window 22 are illustrated on top of dial 18. Although not shown, closure cap 8 typically has the mandated child safety features, such as requiring the closure cap be first pushed down or squeezed before it can be turned to open. Dosage is imprinted on top of closure cap 17 on outer ring 19 and weight on inner ring 20.

Figure 6:
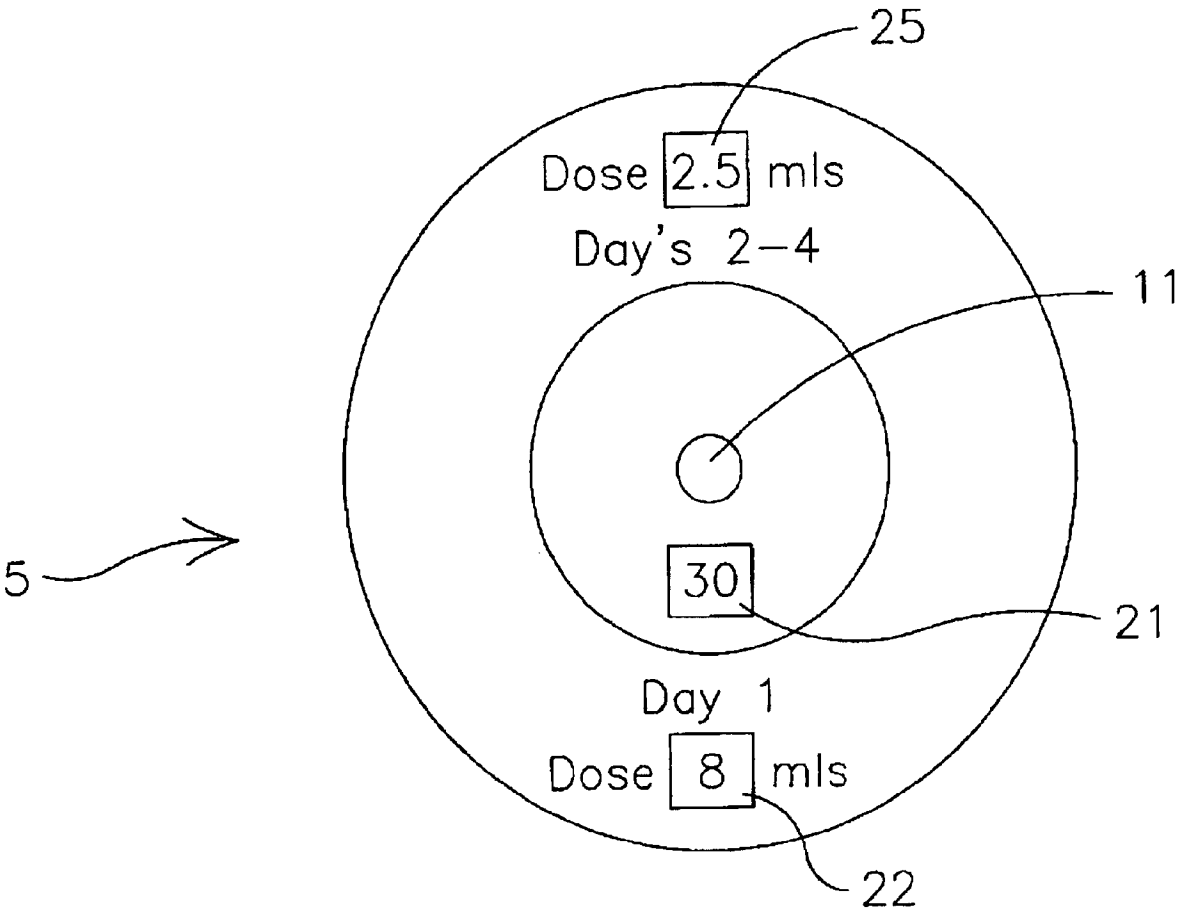
FIG. 6 is a plan view of another embodiment of the dial of a dial indicator cap.

FIG. 6 illustrates an alternate arrangement of dial indicator cap 6 for a medication such as Zithromax suspension that usually requires a higher initial dose and then a lower subsequent dose during the balance of the medication period. The arrangement of the numbers for the dosage corresponding to the weight of the patient is similar to the arrangement previously shown; with the exception that third window 25 is added for the dosage subsequent to the initial dosage period. Although not shown, a corresponding set of numbers for the subsequent dosage is included on top of closure cap 17, either in a third ring or in a separate portion of the same ring that contains the numerical information for the initial dosage. The subsequent dosage window 25 is placed in top of dial 18 to correspond with the placement of the numerical information for the subsequent dosage.

This "Detailed Description And Operation Of The Invention" section describes a medication application embodiment of the invention claimed in this specification only for purposes of illustration. It is to be understood that this invention may be used for myriad other applications. Furthermore, one skilled in the art can make changes in structure, material, and arrangement of structures without departing from the invention.

A number of other applications for the dial indicator cap 6 were set forth in this specification. It is emphasized that the invention has a broader application than to the illustrated embodiment of this specification. The series of numbers within the range of weight described in the embodiment imprinted on inner ring 20 in pounds and viewable through first window 21 is a first set of information 26. First set of information 26 comprises a series of discrete weights of a child, in the case of the illustrated embodiment described in this specification. Each of these discrete weights or numbers is a first information bit 28. Although, in the illustrated embodiment the first bits 28 are a series of weights of a child, they may be weights of anything, a measure of volume of anything, or any other unit of measure of any other thing. Therefore, first set of information 26 is a set of first bits 28 of some type of information, wherein first bits 28 are discrete quantities within the first set of information 26. Similarly, the series of numbers within the range of dosage described in the illustrated embodiment imprinted on outer ring 19 in milliliters and viewable through second window 22 is a second set of information 27. Second set of information 27 also comprises a series of discrete dosage volume numbers, in the case of the illustrated embodiment described in this specification. Each of these discrete numbers is a second information bit 31. Although, based upon the illustrated embodiment the second information bits 31 are a series of dosage volume numbers for medication of a child, they may be volumes of anything, a measure of weight of anything, or any other unit of measure of any other thing. Therefore, second set of information 27 is a second set of information bits 31 of some type of information, wherein second information bits 31 are discrete quantities within the set.

Dial indicator cap 6 provides the user with a means to determine a second bit 31 of a second set of information 27 that is a function of a first bit 28 of a first set of information 26. Generally, the user will choose first bit 28 that indicates the known quantity and use the dial indicator cap to determine second bit 31 that indicates the unknown quantity. Second bit 31 of a second set of information 27 is functionally related to first bit 28 of a first set of information 26 if second bit 31 of the second set of information 27 is dependently related to first bit 28 of the first set of information 26 by some algorithm 29. Furthermore, dial indicator cap 6 may provide, as shown in FIG. 6, the user with a means to determine a third bit 35 of a third set of information 34 that is a function of and dependently related to first bit 28 of the first set of information 26 by some algorithm 29.

What is claimed is:

1. An indicator cap comprising:

(a) a closure cap;

(b) a dial rotatably affixed to the top of the closure cap;

(c) the dial having a first window and a second window;

(d) the top of the closure cap imprinted with a (i) first set of information positioned to be sequentially viewable one first bit at a time throughout its entire range of first bits through the first window upon rotation of the dial and (ii) second set of information positioned to be sequentially viewable one second bit at a time throughout its entire range of second bits through the second window upon rotation of the dial for viewing the first set of information in the first window;

(e) the first set of information related to the second set of information in accordance with an algorithm; and f) a means for rotatable mating engagement of the closure cap with the dial, so that the first and second windows may be releasably maintained in position for viewing a first bit in the first window and a second bit in the second window.

2. The indicator cap of claim 1, wherein the closure cap also comprises a means for mating engagement with a container.

3. The indicator cap of claim 2, wherein the means for mating engagement of the closure cap with the container are threads on the closure cap for mating engagement with threads on the container.

4. The indicator cap of claim 1, also comprising a means for rotatably affixing the dial to the top of the closure cap.

5. The indicator cap of claim 4, wherein the means for rotatably affixing the dial to the top of the closure cap is a rivit through a dial aperture and a closure cap aperture.

6. The indicator cap of claim 4, wherein the means for rotatably affixing the dial to the top of the closure cap also comprises a space between the dial and the closure cap.

7. The indicator cap of claim 1, wherein the first set of information is imprinted on an inner ring.

8. The indicator cap of claim 1, wherein the second set of information is imprinted on an outer ring.

9. The indicator cap of claim 1, wherein the first set of information comprises bits of weight information.

10. The indicator cap of claim 1, wherein the second set of information comprises a bits of volume information.

11. The indicator cap of claim 1, wherein the algorithm for relating the first set of information to the second set of information are predetermined volume bits for corresponding predetermined weights bits.

12. The indicator cap of claim 1, wherein the means for rotatable mating engagement of the closure cap with the dial comprises serrations on the closure cap for rotatable mating engagement with serrations on the dial.

13. The indicator cap of claim 1, wherein the dial also comprises a means for gripping the dial.

14. The indicator cap of claim 13, wherein the means for gripping the dial is at least one grip bump.

15. The indicator cap of claim 1, wherein the sidewall of the dial is extended downward to form a hood.

16. The indicator cap of claim 15, wherein the downwardly extending sidewall has a first upper annular ring diameter around the upper portion of the closure cap and a larger second lower annular ring diameter.

17. The indicator cap of claim 1, also comprising:

(a) a third window in the dial;

(b) the top of the closure cap imprinted with a third set of information positioned to be sequentially viewable one third bit at a time throughout its entire range of third bits through the third window upon rotation of the dial for viewing the first set of information in the first window; and (c) the first set of information related to the third set of information in accordance with a second algorithm.

18. A method of determining a second information bit as a function of a first information bit, comprising the steps of:

(a) selling the first window of the dial indicator cap of claim 1 to a first information bit; and (b) viewing the second information bit in the second window.

19. An indicator cap comprising:

(a) a closure cap comprising threads for mating engagement with threads on a container, serrations, and a top, which top comprises (i) a first set of information imprinted on an inner ring, positioned to be sequentially viewable one first bit at a time throughout its entire range of first bits through a first window upon rotation of a dial, and (ii) a second set of information imprinted on an outer ring, positioned to be sequentially viewable one second bit at a time throughout its entire range of second bits through a second window upon rotation of a dial for viewing the first set of information in the first window;

(b) a dial comprising (i) a first window, (ii) a second window, (iii) a means for rotatably affixing the dial to the closure cap, (iv) serrations for rotatable mating engagement with serrations on the closure cap, so that first and second windows may be releasably maintained in position for viewing a single first bit in first window and a single second bit in the second window, (v) at least one grip bump, and (vi) a hood extending downwards from the dial sidewall; and (c) the first set of information related to the second set of information in accordance with an algorithm.

20. A bottle comprising:

(a) a container;

(b) a dial indicator cap comprising: (i) a means for affixing a closure cap to the container; (ii) a dial rotatably affixed to the top of the cap with a first window and a second window; (iii) the top of the cap imprinted with a first set of information positioned to be sequentially viewable one first bit at a time throughout its entire range of first bits through a first window upon rotation of the dial and a second set of information positioned to be sequentially viewable one second bit at a time throughout its entire range of second bits through a second window upon rotation of the dial for viewing the first set of information in the first window;

(c) the first set of information related to the second set of information in accordance with an algorithm; and d) a means for rotatable mating engagement of the closure cap with the dial, so that the first and second windows may be releasably maintained in position for viewing a first bit in the first window and a second bit in the second window.

21. A medication bottle, comprising:

(a) a container having a means for sealing engagement with a closure cap;

(b) the closure cap having (i) at least one click stop serration on the closure cap top surface; (iii) a first set of weight information bits related to a second set of volume information bits by an algorithm, the first set of weight information bits positioned on an inner ring on the top surface of the closure cap so that one first bit at a time throughout the entire range of first bits is sequentially viewable through a first window upon rotation of a dial; and (ii) a second set of predetermined volume information bits positioned on a first outer ring, concentric with the inner ring, on the top surface of the closure cap so that one second bit at a time throughout the entire range of second bits is sequentially viewable through a second window in the dial upon rotation of the dial;

(c) the dial (i) rotatably affixed to the top surface of the closure cap by a rivit extending axially through both a dial aperture and a closure cap aperture; (ii) having at least one clip stop serration on the dial bottom surface for rotatable mating engagement with the at least one click stop serration on the closure cap top surface, so that the first window and the second window may be releasably maintained in position for viewing a first weight information bit in the first window and a second volume information bit in the second window; (iii) a sidewall on the pheriphery of the dial extending downwardly from the top of the dial to form a hood; and (iv) at least one finger grip bump extending upwardly from the top of the sidewall for gripping the dial; and (d) the algorithm is the second set of volume information bits as a dependent function of the first set of corresponding predetermined weight information bits and the predetermined frequency of dosage.

22. A medication bottle, comprising:

(a) a container having a means for sealing engagement with a closure cap;

(b) a closure cap having (i) at least one click stop serration on the closure cap top surface; (iii) a first set of weight information bits related to a second set and a third set of volume information bits by an algorithm, positioned on an inner ring on the top surface of the closure cap so that one first bit at a time throughout the entire range of first bits is sequentially viewable through a first window in a dial upon rotation of the dial; (ii) a second set of predetermined volume information bits positioned on a first outer ring, concentric with the inner ring, on the top surface of the closure cap so that one second bit at a time throughout the entire range of second bits is sequentially viewable through a second window upon rotation of the dial; and (iii) a third set of predetermined volume information bits positioned on a second outer ring, concentric with the inner ring, on the top surface of the closure cap so that one third bit at a time throughout the entire range of third bits is sequentially viewable through a third window upon rotation of the dial;

(c) the dial (i) rotatably affixed to the top surface of the closure cap by a rivit extending axially through both a dial aperture and a closure cap aperture; (ii) having at least one clip stop serration on the dial bottom surface for rotatable mating engagement with the at least one click stop serration on the closure cap top surface, so that the first window and the second and the first window and the third window may be releasably maintained in position for viewing a first information bit in the first window in the dial, a second information bit in the second window in the dial, and a third information bit in the third window in the dial; (iii) a sidewall on the pheriphery of the dial extending downwardly from the top of the dial to form a hood; and (iv) at least one finger grip bump extending upwardly from the top of the sidewall for gripping the dial;

(d) the algorithm is the second set of volume information bits as a dependent function of the first set of corresponding predetermined weight information bits and the predetermined frequency of dosage; and (e) the algorithm is the third set of volume information bits as a function of the first set of corresponding predetermined weight information bits and the frequency of dosage.

23. An indicator cap comprising:

(a) a closure cap;

(b) a dial rotatably affixed to the top of the closure cap;

(c) the dial having a first window and a second window;

(d) the top of the closure cap having a (i) first set of bits of weight information positioned to be sequentially viewable one first bit at a time throughout its entire range of first bits through the first window upon rotation of the dial and (ii) second set of bits of volume information positioned to be sequentially viewable one second bit at a time throughout its entire range of second bits through the second window upon rotation of the dial for viewing the first set of information in the first window;

(e) the second set of volume information bits related to the first set of corresponding weight information bits in accordance with an algorithm; and f) a means for rotatable mating engagement of the closure cap with the dial, so that the first and second windows may be releasably maintained in position for viewing a first bit in the first window and a second bit in the second window.

24. A medication bottle, comprising:

(a) a container having a means for sealing engagement with a closure cap;

(b) the closure cap having (i) a means for indexing the closure cap with a dial so that the dial is releasably maintained in position for viewing a first weight information bit in a first window and a second volume information bit in a second window; (ii) the first set of weight information bits related to the second set of volume information bits by an algorithm, the first set of weight information bits positioned on a first ring on the top surface of the closure cap so that one first bit at a time throughout the entire range of first bits is sequentially viewable through the first window in the dial upon rotation of the dial; and (iii) the second set of predetermined volume information bits positioned on a second ring, concentric with the first ring, on the top surface of the closure cap so that one second bit at a time throughout the entire range of second bits is sequentially viewable through the second window in the dial upon rotation of the dial;

(c) the dial having (i) a means for rotatably affixing the dial to the top surface of the closure cap and (ii) a means for gripping the dial so that the dial may be rotated; and (d) the algorithm is the second set of volume information bits as a dependent function of the first set of corresponding weight information bits and the predetermined frequency of dosage.

* * * * *